US011076222B2

(12) United States Patent
Irii et al.

(10) Patent No.: US 11,076,222 B2
(45) Date of Patent: Jul. 27, 2021

(54) ELECTRO-ACOUSTIC TRANSDUCER AND ELECTRO-ACOUSTIC CONVERSION DEVICE

(71) Applicant: AUDIO-TECHNICA CORPORATION, Tokyo (JP)

(72) Inventors: Koichi Irii, Tokyo (JP); Hiroshi Akino, Tokyo (JP)

(73) Assignee: Audio-Technica Corporation, Tokyo (JP)

( * ) Notice: Subject to any disclaimer, the term of this patent is extended or adjusted under 35 U.S.C. 154(b) by 0 days.

(21) Appl. No.: 16/717,362

(22) Filed: Dec. 17, 2019

(65) Prior Publication Data

US 2020/0196047 A1 Jun. 18, 2020

(51) Int. Cl.

| | |
|---|---|
| ***H04R 1/10*** | (2006.01) |
| ***H04R 1/28*** | (2006.01) |
| ***H04R 7/16*** | (2006.01) |
| ***H04R 19/02*** | (2006.01) |
| ***H04R 19/01*** | (2006.01) |
| ***H04R 19/00*** | (2006.01) |

(52) U.S. Cl.

CPC ..... *H04R 1/283* (2013.01); *H04R 1/10* (2013.01); *H04R 1/1016* (2013.01); *H04R 7/16* (2013.01); *H04R 19/005* (2013.01); *H04R 19/013* (2013.01); *H04R 19/02* (2013.01); *H04R 2201/003* (2013.01); *H04R 2205/022* (2013.01)

(58) Field of Classification Search

CPC ..... H04R 1/10; H04R 1/1016; H04R 1/1058; H04R 1/1075; H04R 7/16; H04R 19/00; H04R 19/005; H04R 19/013; H04R 2205/022; H04R 19/02; H04R 2201/003

USPC ..... 381/191

See application file for complete search history.

(56) References Cited

U.S. PATENT DOCUMENTS 5,450,498 A * 9/1995 Whitehead ..... B06B 1/0292 381/174
6,510,231 B2 * 1/2003 Barnert ..... H04R 19/00 381/174

(Continued)

FOREIGN PATENT DOCUMENTS

| | | | |
|---|---|---|---|
| EP | 2 555 544 | A2 | 2/2013 |
| JP | 2017-183851 | A | 10/2017 |
| WO | 2017/161667 | A1 | 9/2017 |

OTHER PUBLICATIONS

European Search Report: Audio-Technica Corporation, Reference 70228EP01, Application No. 19216518.1, dated May 6, 2020.

*Primary Examiner* — Huyen D Le
(74) *Attorney, Agent, or Firm* — W & C IP

(57) ABSTRACT

An electro-acoustic transducer includes: a housing; a fixed electrode; a diaphragm that oscillates in accordance with a potential difference between the diaphragm and the fixed electrode generated based on the electric signal, the diaphragm being provided to face the fixed electrode; and a support part that supports the partial region of the diaphragm toward the fixed electrode, the support part including a displacement part that is displaced in a direction in which the diaphragm is displaced in response to a change in pressure inside the housing, and a contacting part contacts the partial region of the diaphragm, wherein a distance between the diaphragm and the fixed electrode in the partial region is less than a distance between the diaphragm and the fixed electrode outside the partial region.

16 Claims, 12 Drawing Sheets

(56) References Cited

U.S. PATENT DOCUMENTS

| | | | | |
|---|---|---|---|---|
| 8,116,502 | B2 * | 2/2012 | Saggio, Jr. ..... | H04R 1/1016 381/380 |
| 8,948,435 | B2 * | 2/2015 | Oosato ..... | H04R 1/1075 381/380 |
| 10,433,055 | B2 | 10/2019 | Zhao et al. | |
| 2012/0117211 | A1 | 5/2012 | Yamkovoy et al. | |
| 2013/0202127 | A1 * | 8/2013 | Miyakura ..... | H04R 19/013 381/74 |
| 2017/0099537 | A1 | 4/2017 | Leonidovich | |
| 2017/0289667 | A1 * | 10/2017 | Okita ..... | H04R 1/1041 |
| 2018/0035212 | A1 | 2/2018 | Shao et al. | |
| 2019/0028804 | A1 | 1/2019 | Zhao et al. | |

* cited by examiner

ELECTRO-ACOUSTIC TRANSDUCER AND ELECTRO-ACOUSTIC CONVERSION DEVICE

CROSS-REFERENCE TO RELATED APPLICATIONS

The present application claims priority to Japanese Patent Application Number 2018-235314, filed on Dec. 17, 2018. The contents of this application are incorporated herein by reference in their entirety.

BACKGROUND OF THE INVENTION

The present invention relates to an electro-acoustic transducer and an electro-acoustic conversion device for converting an electrical signal into a sound.

Conventionally, an electro-acoustic transducer having a flat plate-shaped fixed electrode (hereinafter referred to as a fixed electrode) and a diaphragm provided to face the fixed electrode is known. Japanese Unexamined Patent Application Publication No 2017-183851 discloses a capacitor type earphone in which a peripheral portion of a thin-film diaphragm is fixed to a housing.

In the electro-acoustic transducer for converting the electrical signal into sound, such as the condenser-type earphone or headphone, the pressure inside the electro-acoustic transducer changes as the pressure inside an ear canal changes depending on a wearing condition of the electro-acoustic transducer. If the pressure inside the electro-acoustic transducer changes while the diaphragm is fixed to the housing only at the peripheral portion of the diaphragm, there is a problem that the diaphragm may be broken due to a displacement of the diaphragm since stress is concentrated on the peripheral portion of the diaphragm.

BRIEF SUMMARY OF THE INVENTION

This invention focuses on this point, and an object of the invention is to provide an electro-acoustic transducer and an electro-acoustic conversion device in which a diaphragm is difficult to break.

The electro-acoustic transducer according to the first aspect of the present invention is an electro-acoustic transducer for converting an electrical signal into a sound, the electro-acoustic transducer includes: a housing having a sound emitting part that emits the sound to the outside; a fixed electrode fixed to the housing; a diaphragm that oscillates in accordance with a potential difference between the diaphragm and the fixed electrode generated based on the electrical signal, the diaphragm being provided to face the fixed electrode; and a support part that supports a partial region of the diaphragm toward the fixed electrode, the support part including a displacement part that is displaced in a direction in which the diaphragm is displaced in response to a change in pressure inside the housing, and a contacting part that is coupled to the displacement part and contacts the partial region with a surface having elasticity, wherein a distance between the diaphragm and the fixed electrode in the partial region is less than a distance between the diaphragm and the fixed electrode outside the partial region.

The electro-acoustic conversion device according to the second aspect of the present invention includes: a first electro-acoustic transducer; and a second electro-acoustic transducer, wherein the first electro-acoustic transducer is an electro-acoustic transducer for converting an electrical signal into a sound, the first electro-acoustic transducer includes: a housing having a sound emitting part that emits the sound to the outside; a fixed electrode fixed to the housing; a diaphragm that oscillates in accordance with a potential difference between the diaphragm and the fixed electrode generated based on the electrical signal, the diaphragm being provided to face the fixed electrode; and a support part that supports a partial region of the diaphragm toward the fixed electrode, the support part including a displacement part that displaces in a direction in which the diaphragm is displaced in response to a change in pressure inside the housing, and a contacting part that is coupled to the displacement part and contacts the partial region with a surface having elasticity, the second electro-acoustic transducer is an electro-acoustic transducer in which the sensitivity in high frequencies is higher than the sensitivity of the first electro-acoustic transducer, and the sensitivity in low frequencies is lower than the sensitivity of the first electro-acoustic transducer, and a distance between the diaphragm and the fixed electrode in the partial region is less than a distance between the diaphragm and the fixed electrode outside the partial region.

DETAILED DESCRIPTION OF THE INVENTION

Hereinafter, the present invention will be described through exemplary embodiments of the present invention, but the following exemplary embodiments do not limit the invention according to the claims, and not all of the combinations of features described in the exemplary embodiments are necessarily essential to the solution means of the invention.

[Outline of an Earphone 1]

Figure 1:
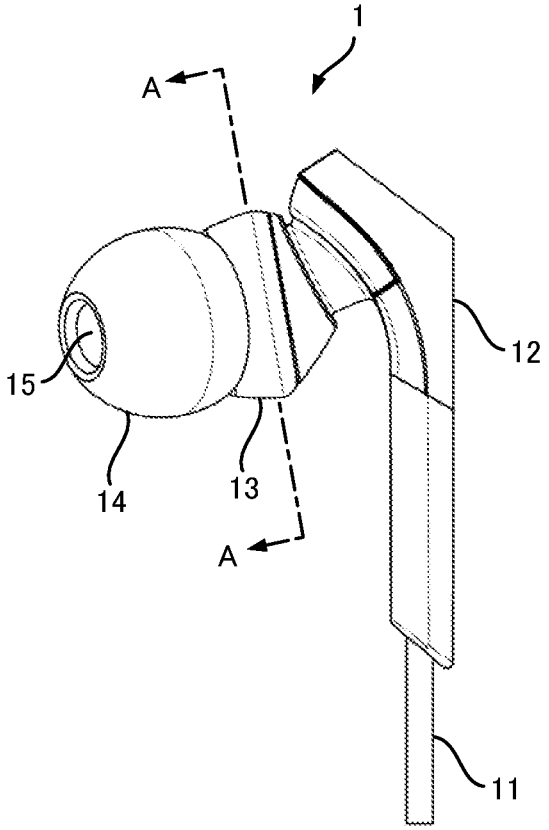
FIG. 1 shows the appearance of an earphone 1 which is an example of an electro-acoustic conversion device.

FIG. 1 shows the appearance of an earphone 1 which is an example of an electro-acoustic conversion device. The earphone 1 includes a cable 11, a rear housing 12, a front housing 13, and an earpiece 14. An opening 15 that emits a sound to the outside is formed at a tip of the earpiece 14.

The cable 11 is a cable for transmitting an electrical signal supplied from a sound source. The rear housing 12 is a member for coupling the cable 11 and the front housing 13. The rear housing 12 is formed of, for example, a resin shaped to cover a cable.

The front housing 13 is provided between the rear housing 12 and the earpiece 14, and has a configuration in which an angle with respect to the rear housing 12 is variable. The front housing 13 has an electro-acoustic transducer 20 that converts the electrical signal transmitted through the cable 11 into a sound. An internal structure of the electro-acoustic transducer 20 will be described in detail later.

The earpiece 14 is a part to be inserted into an ear of a user of the earphone 1, and is coupled to a sound conduit projecting from the front housing 13. The sound generated by the electro-acoustic transducer 20 is emitted from the opening 15 of the earpiece 14.

[Detailed Configuration of the Electro-Acoustic Transducer 20]

Figure 2:
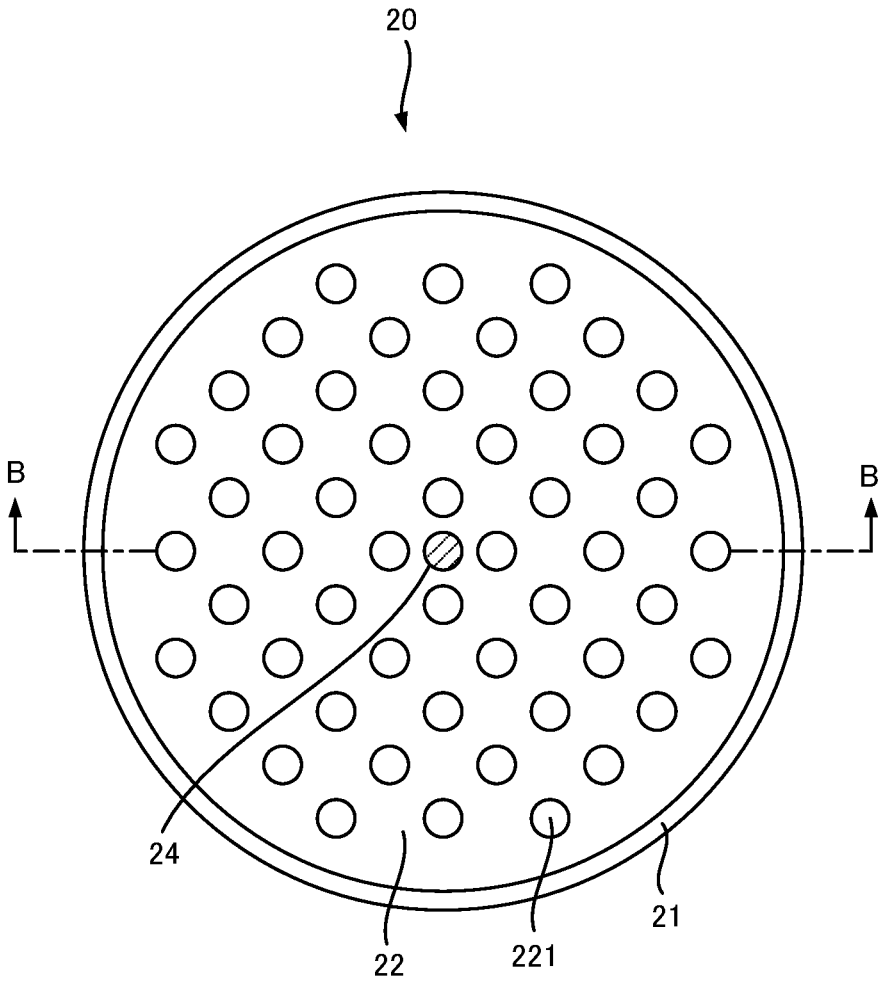
FIG. 2 is a cross-sectional view taken along line A-A of FIG. 1.
Figure 3:
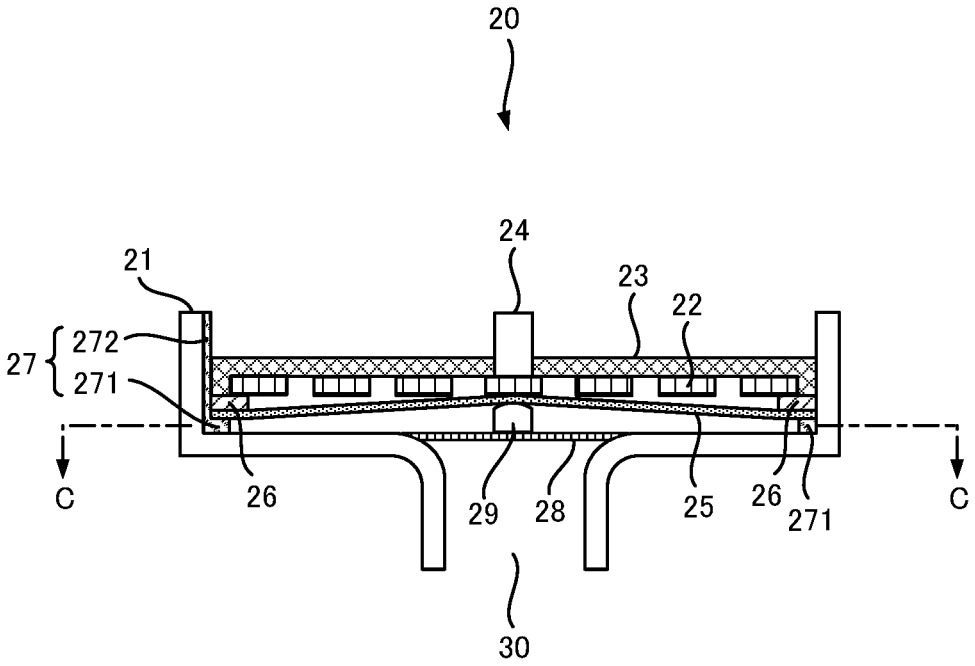
FIG. 3 is a cross-sectional view taken along line B-B of FIG. 2.
Figure 4:
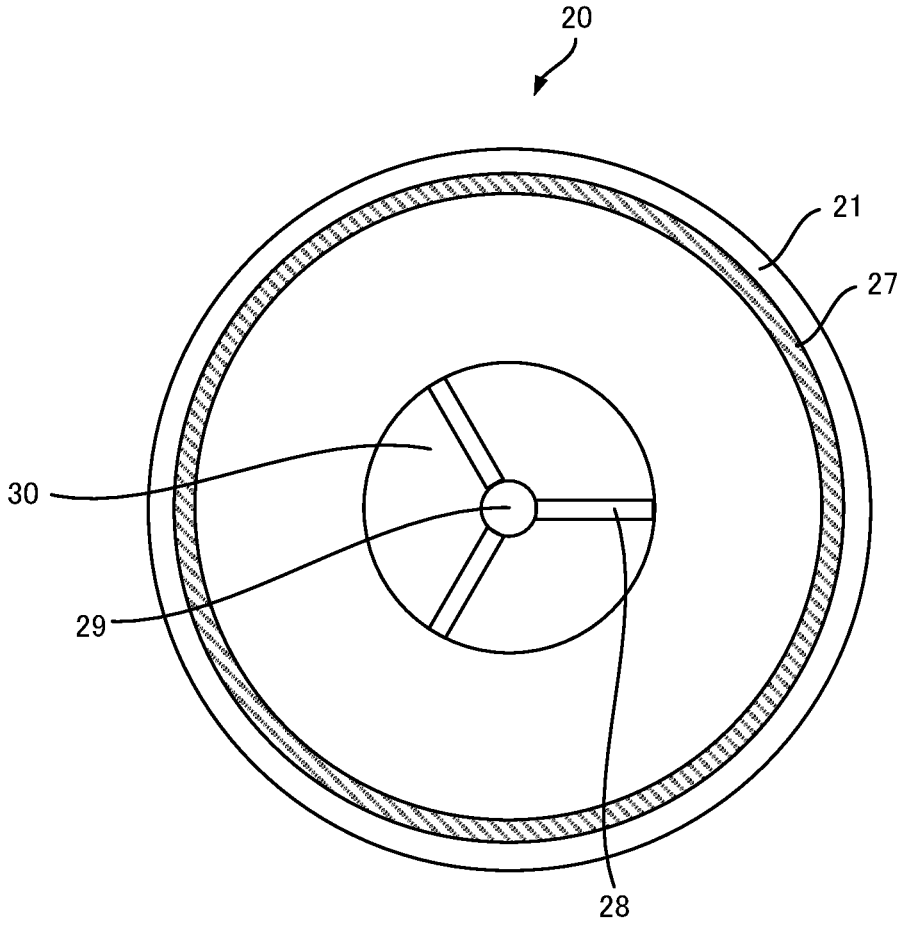
FIG. 4 is a view of an earpiece 14 viewed from line C-C of FIG. 3.

FIGS. 2 to 4 are each a schematic diagram showing the internal structure of the electro-acoustic transducer 20. FIG. 2 is a cross-sectional view taken along line A-A of FIG. 1. FIG. 3 is a cross-sectional view taken along line B-B of FIG. 2. FIG. 4 is a view of the earpiece 14 viewed from the line C-C in FIG. 3.

As shown in FIGS. 2 to 4, the electro-acoustic transducer 20 includes a housing 21, a fixed electrode 22, a fixed electrode cover 23, a terminal 24, a diaphragm 25, an insulating member 26, a conductive member 27, a displacement part 28, and a contacting part 29.

The housing 21 is formed of a resin, for example, and has a space for accommodating a component for generating the sound based on the electrical signal supplied from the sound source. The housing 21 communicates with the space, and has a sound emitting part 30 that emits the sound generated based on the electrical signal to the outside through opening of the earpiece 14. The sound emitting part 30 is a part having a cylindrical shape, for example, and extends toward the earpiece 14.

In the housing 21, the side receiving the electrical signal is coupled to the rear housing 12 and the side emitting the sound is coupled to the side of the earpiece 14. In FIGS. 2 to 4, an example of a case where the housing 21 has a circular cross-section is shown, but the shape of the housing 21 may be any shape and the housing 21 may have a polygonal cross-section.

The fixed electrode 22 is formed of a flat plate-shaped conductive member (e.g., aluminum), and generates an electric field between the diaphragm 25 (*i*) by applying a bias voltage through the terminal 24 or (ii) due to an external electric field of an electret. Also, the electrical signal input from the sound source is input to the fixed electrode 22 through the terminal 24 and to the diaphragm 25 through the conductive member 27. For example, when the earphone 1 is a non-balanced connection earphone, diaphragm 25 is at a ground level and an electrical signal corresponding to the sound (hereinafter, "sound signal") is input to the fixed electrode 22. When the earphone 1 is a balanced connection earphone, a sound signal of the first polarity is input to the fixed electrode 22 and a sound signal of the second polarity, which is with reverse polarity to the first polarity, is input to the diaphragm 25.

The fixed electrode 22 is fixed to the housing 21 via the fixed electrode cover 23, for example. The shape and size of the fixed electrode 22 are arbitrary, and the fixed electrode 22 has, for example, a disk shape with a diameter of 20 mm. The fixed electrode 22 has a plurality of sound holes 221 through which sound generated by the vibration of the diaphragm 25 passes.

The fixed electrode cover 23 has a recessed portion for accommodating the fixed electrode 22. The fixed electrode cover 23 is formed of an insulating member. Since the outer edge of the fixed electrode 22 is surrounded by the insulating member, the fixed electrode 22 and the conductive member 27, which will be described later, are electrically insulated from each other.

The terminal 24 is a conductive terminal for supplying the electrical signal to the fixed electrode 22. The terminal 24 is the first conductive member coupled to the fixed electrode 22 on the side of the fixed electrode 22 opposite the sound emitting part 30. The terminal 24 is electrically coupled to the fixed electrode 22, and the electrical signal, supplied from the sound source, is input to the terminal 24 while being superimposed on a bias voltage or on a surface potential of the electret.

The diaphragm 25, which is provided to face the fixed electrode 22, is a plate that oscillates based on the electrical signal supplied from the sound source. The diaphragm 25 is formed of a thin film having conductivity. The diaphragm 25 is formed of, for example, a metal foil or a polymer film on which gold is vapor-deposited.

The diaphragm 25 oscillates in accordance with a potential difference between the terminal 24 and the conductive member 27 generated by the electrical signal. Specifically, the diaphragm 25 oscillates in accordance with the potential difference generated between the fixed electrode 22 on the basis of the electrical signals (the reference signal and the sound signal) applied to the terminal 24 and the conductive member 27. More specifically, the diaphragm 25 oscillates in accordance with a change in the magnitude of an AC component of the potential difference generated between the terminal 24 and the conductive member 27.

A partial region of the diaphragm 25, namely the central region in the example shown in FIG. 2, is pressed against the fixed electrode 22 side by the contacting part 29, and a distance between the diaphragm 25 and the fixed electrode 22 in the partial region is less than a distance between the diaphragm 25 and the fixed electrode 22 outside the partial region. The diaphragm 25 is made to contact the fixed electrode 22 in the partial region by pressure applied by the contacting part 29. This configuration of the diaphragm 25 improves the sensitivity of the electro-acoustic transducer 20 to electrical signals in a wide range of frequencies, since the distance between the diaphragm 25 and the fixed electrode 22 varies depending on the position of the diaphragm 25.

The insulating member 26 is provided to prevent the diaphragm 25 from conducting with the fixed electrode 22, and is formed of a resin, for example. The entire insulating member 26 may be formed of an insulating member, and at least one of (i) the surface of the insulating member 26 contacting the fixed electrode 22 and (ii) the surface of the insulating member 26 contacting the diaphragm 25 may have insulation properties.

The insulating member 26 has an annular shape, for example, and is sandwiched between a peripheral portion of the diaphragm 25 and the fixed electrode 22. As a result, the peripheral portion of the diaphragm 25 is fixed without contacting the fixed electrode 22, and a region of the diaphragm 25 not contacting the insulating member 26 oscillates in response to the electrical signal.

The conductive member 27 is a member for applying the electrical signal to the diaphragm 25. The conductive member 27 is the second conductive member coupled to the diaphragm 25 on the side of the sound emitting part 30 with respect to the fixed electrode 22. The conductive member 27 is formed of a conductive sheet, for example. The conductive member 27 has (i) an annular portion 271 in contact with the peripheral portion of the diaphragm 25 and (ii) an extension portion 272 extending from at least a part of the annular portion 271 to the opposite side of the sound emitting part 30 with respect to the fixed electrode 22. The extension portion 272 extends to the rear housing 12 side passing between (i) the housing 21 and (ii) the fixed electrode cover 23 and the insulating member 26.

The displacement part 28 and the contacting part 29 form a support part for supporting the partial region of the diaphragm 25 toward the fixed electrode 22, and apply pressure to the partial region of the diaphragm 25. The displacement part 28 is formed of, for example, an elastic rod-shaped resin, spring, or rubber, and is displaced in a direction in which the diaphragm 25 is displaced in response to a change in pressure inside the housing 21. Specifically, when the diaphragm 25 is displaced in response to a pressure change in the housing 21 that occurs when the earpiece 14, which is a part of a housing of the earphone 1, is worn in a human ear or when the earpiece 14 is removed from the human ear, the displacement part 28 is displaced by receiving stress caused by displacement of the diaphragm 25.

In the example shown in FIG. 4, the displacement part 28 is provided in a manner traversing the sound emitting part 30. That is, the displacement part 28 is provided at a position between the diaphragm 25 and the sound emitting part 30 in a manner traversing an opening of the sound emitting part 30 when the displacement part 28 is seen from the opening. The displacement part 28 has one or more rod-shaped members that traverse the sound emitting part 30. Specifically, the displacement part 28 has a plurality of rod-shaped members each having one end fixed to the opening of the sound emitting part 30. In the example shown in FIG. 4, three rod-shaped members extend, in a direction shifted by 120 degrees each, from the opening on the diaphragm 25 side of the sound emitting part 30, and are coupled at the center of the sound emitting part 30, but the direction in which the rod-shaped members extend and the number of rod-shaped members are arbitrary.

The rod-shaped member included in the displacement part 28 may be formed by being molded integrally with the housing 21, and a rod-shaped member different from the housing 21 may be fixed to the housing 21 by an adhesive or the like. The rod-shaped member shown in FIG. 4 has a uniform thickness, but the rod-shaped member may have a shape that becomes thinner toward the center of the opening (i.e., the position where the contacting part 29 is provided) of the sound emitting part 30. The rod-shaped member having the aforementioned shape not only increases the coupling force between the rod-shaped member and the sound emitting part 30 but is also easily deflected in response to the pressure change in the housing 21.

The contacting part 29 is coupled to the displacement part 28 and contacts the partial region of the diaphragm 25 with a surface having elasticity. The contacting part 29 is provided at the center of the displacement part 28, for example, and in the example shown in FIG. 4, the contacting part 29 is provided at a position where the plurality of rod-shaped members included in the displacement part 28 are coupled. The contacting part 29 has elasticity such that its surface deforms due to the displacement of the diaphragm 25 toward the sound emitting part 30 when the user removes the earphone 1 from the ear and the inside of the housing 21 is decompressed.

It is preferable that the contacting part 29 is formed of a resin which has (i) fluidity so that a curved surface is formed by the surface tension before curing and (ii) elasticity which increases as time passes. The resin is elastic after curing. By forming the contacting part 29 with such materials, the contacting part 29 can be easily formed into a desired shape. Examples of such materials include, but are not limited to, nitrile rubber-based adhesives, synthetic rubber-based adhesives, vinyl-based adhesives, silicone rubber, and sponges. The contacting part 29 may be formed of the same material as the displacement part 28, for example, or may be formed of an ABS resin. Since the contacting part 29 is formed of the materials having elasticity, the diaphragm 25 does not locally receive stress from the contacting part 29, and therefore the diaphragm 25 is difficult to break.

It is preferable that an amount of displacement of the tip of the contacting part 29, when a predetermined stress in a direction in which the diaphragm 25 is displaced is applied to the contacting part 29, is larger than an amount of displacement of the displacement part 28 when the predetermined stress in the direction in which the diaphragm 25 is displaced is applied to the displacement part 28. With this configuration of the contacting part 29, the contacting part 29 deforms before the displacement part 28 is displaced at the time the diaphragm 25 is displaced toward the sound emitting part 30 by the change in the pressure inside the housing 21, so that the stress applied to the diaphragm 25 can be reduced.

<Experiments>

Figure 5:
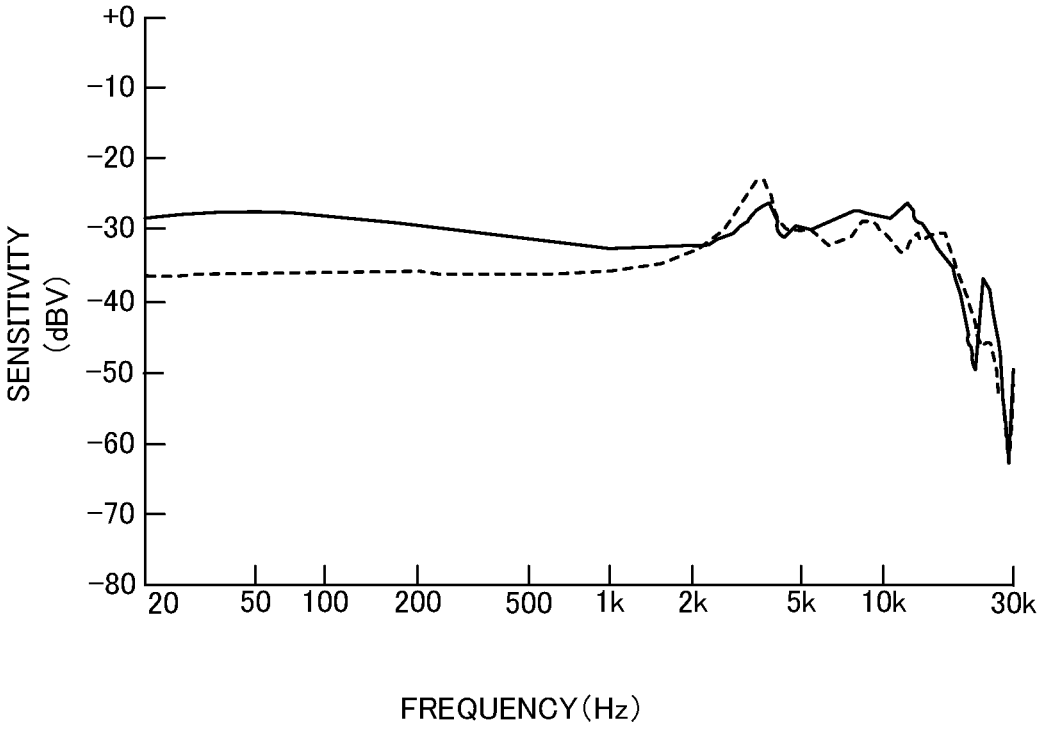
FIG. 5 is a graph showing frequency characteristics of sensitivity of a prototype of the earphone 1.

FIG. 5 is a graph showing frequency characteristics of sensitivity of a prototype of the earphone 1. In FIG. 5, the horizontal axis represents the frequency, and the vertical axis represents the sensitivity. The broken line in FIG. 5 indicates the frequency characteristics of the sensitivity when the earphone 1 does not have the displacement part 28 and the contacting part 29, and the solid line indicates the frequency characteristics of the sensitivity when the earphone 1 has the displacement part 28 and the contacting part 29.

As is apparent from FIG. 5, in the range of 1 kHz or below, the sensitivity of the earphone 1 with the displacement part 28 and the contacting part 29 is about 5 dB to 10 dB better than the sensitivity of the earphone 1 without the displacement part 28 and the contacting part 29. This is considered to be due to the fact that the distance between the diaphragm 25 and the fixed electrode 22 differs depending on the position of the diaphragm 25 since the contacting part 29 having elasticity presses the central part of the diaphragm 25 against the fixed electrode 22.

Variation Example 1 of the Electro-Acoustic Transducer 20

Figure 6:
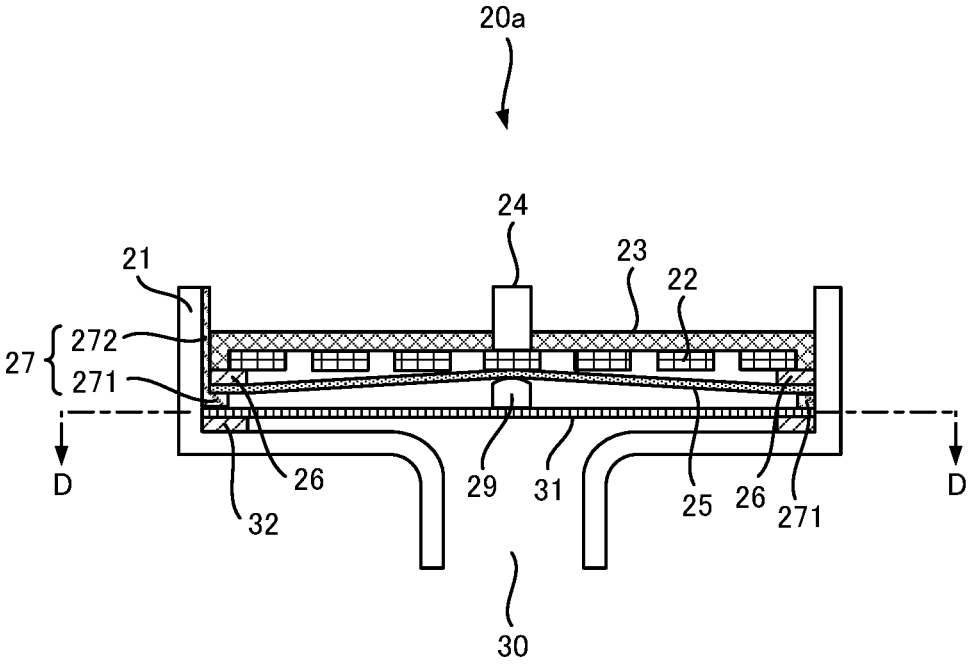
FIG. 6 shows an internal structure of an electro-acoustic transducer 20*a*.
Figure 7:
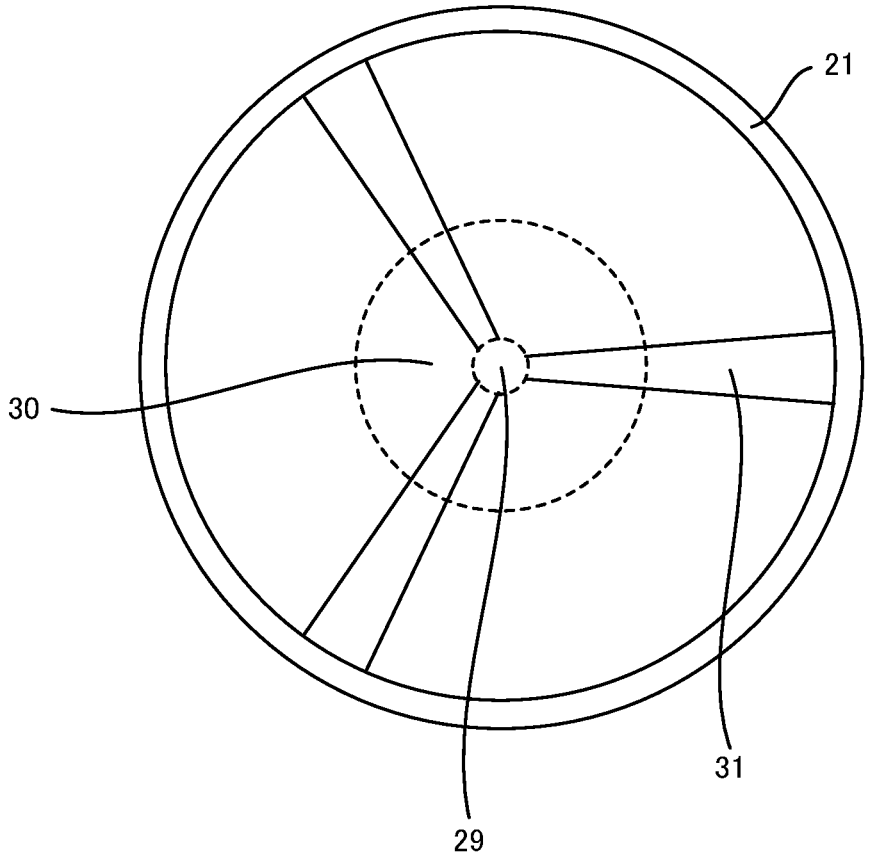
FIG. 7 is a cross-sectional view taken along line D-D of FIG. 6.

FIG. 6 and FIG. 7 each show an internal structure of an electro-acoustic transducer 20*a* which is Variation Example 1 of the electro-acoustic transducer 20. FIG. 7 is a cross-sectional view taken along line D-D of FIG. 6. In the electro-acoustic transducer 20 shown in FIGS. 3 and 4, one end of the displacement part 28 is fixed to a position of the opening of the sound emitting part 30, whereas in the electro-acoustic transducer 20*a* shown in FIGS. 6 and 7, a displacement part 31 is provided so as to face the entire surface of the diaphragm 25. A rod-shaped member included in the displacement part 31 is longer than the rod-shaped member included in the displacement part 28.

The displacement part 31 is fixed so as to be sandwiched between a spacer 32 and the conductive member 27. The spacer 32 is an annular member, and is fixed to an inner surface of the housing 21. The spacer 32 has a thickness greater than the width the displacement part 31 displaces, and the displacement part 31 does not contact the housing 21 even in the state of the maximum displacement. Since the electro-acoustic transducer 20*a* has the displacement part 31 having the rod-shaped member longer than the displacement part 28, the displacement part 31 deflects more easily than the displacement part 28 when the diaphragm 25 is displaced due to a change in the pressure inside the electro-acoustic transducer 20*a*, and therefore the stress applied to the diaphragm 25 can be further reduced.

Further, the rod-shaped member included in the displacement part 31 has, for example, a shape that becomes thinner toward the position where the contacting part 29 is provided. Since the rod-shaped member has the aforementioned shape, not only the peripheral portion of the displacement part 31 can be fixed stably, but also the region near the contacting part 29 provided in the displacement part 31 can be deflected easily.

Variation Example 2 of the Electro-Acoustic Transducer 20

Figure 8:
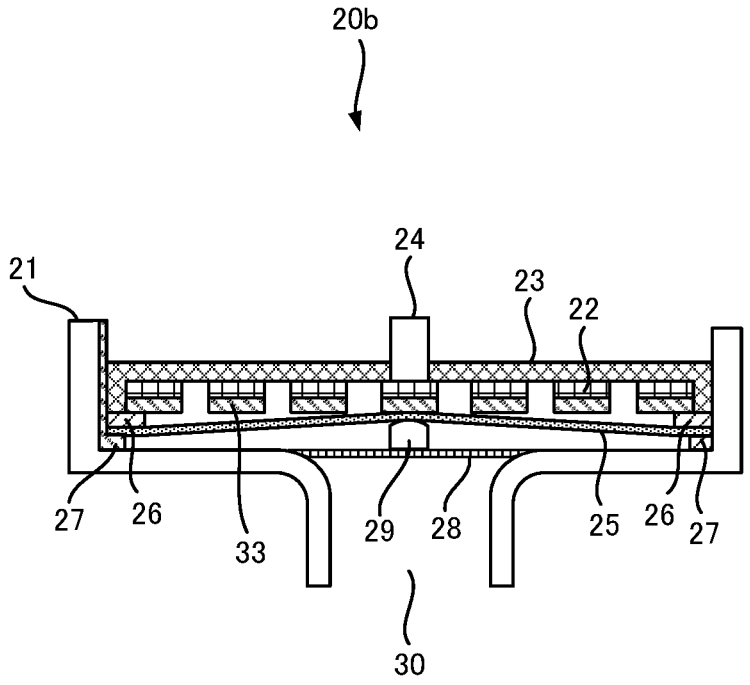
FIG. 8 shows an internal structure of an electro-acoustic transducer 20*b*.

FIG. 8 shows an internal structure of an electro-acoustic transducer 20*b* which is Variation Example 2 of the electro-acoustic transducer 20. The electro-acoustic transducer 20*b* shown in FIG. 8 differs from the electro-acoustic transducer 20 in the point that the electro-acoustic transducer 20*b* has an electret layer 33, and the other configurations are the same as those of the electro-acoustic transducer 20. The electret layer 33 includes a dielectric that semi-permanently retains the charge, and applies a bias voltage to the fixed electrode 22.

The electret layer 33 is provided on a surface of the fixed electrode 22 facing the diaphragm 25. The peripheral portion of the diaphragm 25 is sandwiched between the insulating member 26 and the annular conductive member 27 which have annular shapes.

In the example shown in FIG. 8, the electret layer 33, in a state overlapped with the fixed electrode 22, is accommodated in the recessed portion of the fixed electrode cover 23. In the electret layer 33, sound holes are formed at the same positions as the sound holes 221 formed in the fixed electrode 22. In the fixed electrode 22 and the electret layer 33, the sound holes are formed, for example, by punching in the overlapped state. Because the electret layer 33 is accommodated in the fixed electrode cover 23, the electret layer 33 and the conductive member 27 are insulated from each other, and therefore the bias voltage is not applied to the diaphragm 25. Since the electro-acoustic transducer 20*b* has the electret layer 33, there is no need to apply a DC bias voltage from the outside, thereby improving the user's usability.

Variation Example 3 of the Electro-Acoustic Transducer 20

Figure 9:
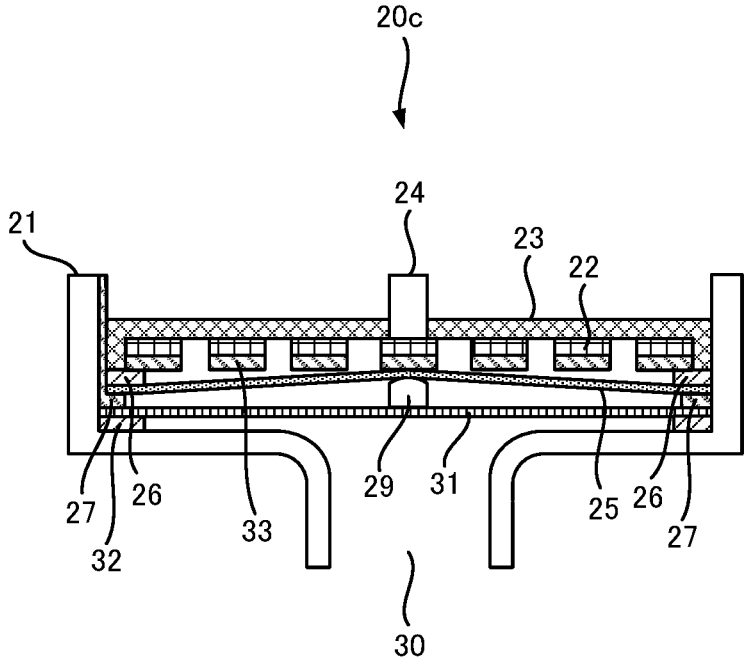
FIG. 9 shows an internal structure of an electro-acoustic transducer 20*c*.

FIG. 9 shows an internal structure of the electro-acoustic transducer 20*c* which is Variation Example 3 of the electro-acoustic transducer 20. The electro-acoustic transducer 20*c* has the displacement part 31 of the electro-acoustic transducer 20*a* shown in FIG. 6, instead of the displacement part 28 of the electro-acoustic transducer 20*b*. The displacement part 31 is sandwiched by the conductive member 27 and the spacer 32. As shown in Variation Examples 1 to 3, a combination of means for applying the bias voltage to the fixed electrode 22 and means for displacing the contacting part 29 may be any combination.

Variation Example 1 of the Front Housing 13

Figure 10:
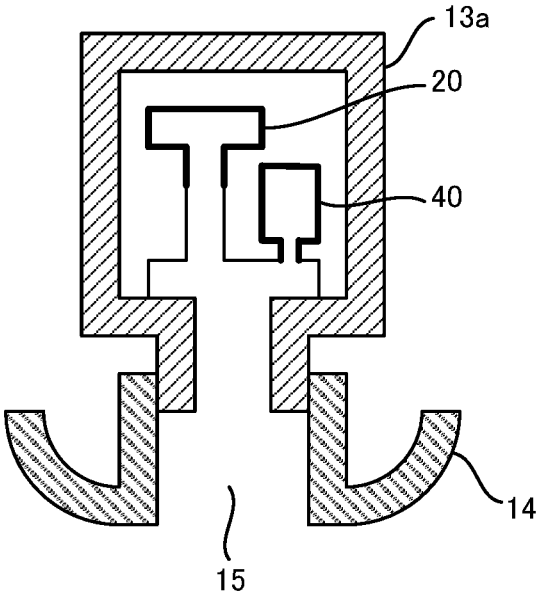
FIG. 10 schematically shows an internal structure of a front housing 13*a*.

FIG. 10 schematically shows an internal structure of a front housing 13*a* which is Variation Example 1 of the front housing 13. The front housing 13 according to the first to fourth embodiments has one electro-acoustic transducer, but the front housing 13*a* differs from the front housing 13 in that the front housing 13*a* has, as a plurality of electro-acoustic transducers, the electro-acoustic transducer 20 serving as a first electro-acoustic transducer and an electro-acoustic transducer 40 serving as a second electro-acoustic transducer. Hereinafter, a case where the front housing 13*a* has the electro-acoustic transducer 20 will be described.

The electro-acoustic transducer 40 is an electro-acoustic transducer in which the sensitivity in high frequencies is higher than the sensitivity of the electro-acoustic transducer 20, and the sensitivity in low frequencies is lower than the sensitivity of the electro-acoustic transducer 20. The electro-acoustic transducer 40 is a balanced armature (BA) electro-acoustic transducer which oscillates a diaphragm by passing a current through a coil attached to a magnet to oscillate an armature.

As results of experiment in FIG. 5 show, the electro-acoustic transducer 20 has better sensitivity than the conventional electro-acoustic transducer in low frequencies (for example, frequencies below 1 KHz). Therefore, good sensitivity can be obtained over a wide frequency range since the front housing 13*a* has both the electro-acoustic transducer 20 that is relatively sensitive in low frequencies and the electro-acoustic transducer 40 that is relatively sensitive in high frequencies.

The front housing 13*a* may include the electro-acoustic transducer 40 on the side close to the ear (i.e., on the sound emitting part 30 side) and the electro-acoustic transducer 20 on the side far from the ear (i.e., on the sound source side). Since the front housing 13*a* has such a configuration, it is possible to reduce an amount of attenuation until a high-frequency sound, which is relatively easy to attenuate, reaches the ear, and therefore even better sensitivity can be obtained over a wide frequency range.

Variation Example 2 of the Front Housing 13

Figure 11:
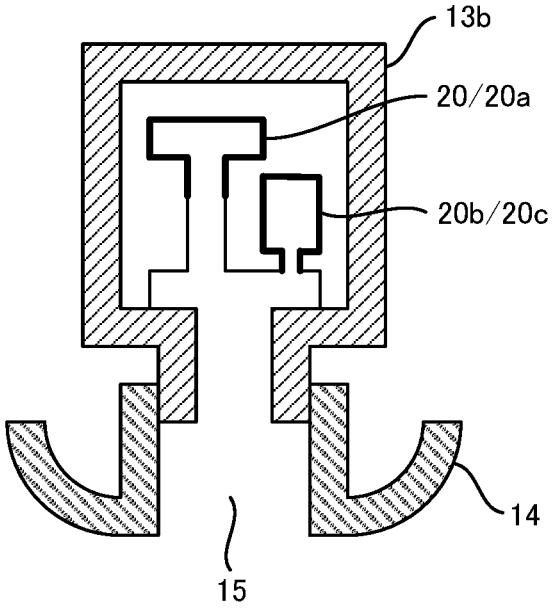
FIG. 11 is schematically shows an internal structure of a front housing 13*b*.

FIG. 11 schematically shows an internal structure of a front housing 13*b* which is Variation Example 2 of the front housing 13. The front housing 13*b* may have, as a plurality of electro-acoustic transducers, (i) the electro-acoustic transducer 20 or the electro-acoustic transducer 20*a* to which a DC voltage is supplied from the outside, and (ii) the electro-acoustic transducer 20*b* or the electro-acoustic transducer 20*c* having an electret layer. The electro-acoustic transducer 20*b* or the electro-acoustic transducer 20*c* is for high frequencies, for example, and the sensitivity in high frequencies is higher than the sensitivity of the electro-acoustic transducer 20 or the electro-acoustic transducer 20*a*.

When the electro-acoustic transducer 20*b* or the electro-acoustic transducer 20*c* functions as an electro-acoustic transducer mainly for high frequency, the diameter of the diaphragm 25 of the electro-acoustic transducer 20*b* or the electro-acoustic transducer 20*c* can be made less than the diameter of the diaphragm 25 of the electro-acoustic transducer 20 or the electro-acoustic transducer 20*a*. Therefore, the front housing 13*b* can obtain even better sensitivity over a wide frequency range, and downsizing of the electro-acoustic transducer 20*b* and the electro-acoustic transducer 20*c* can be realized.

Variation Example of the Displacement Part

Figure 12:
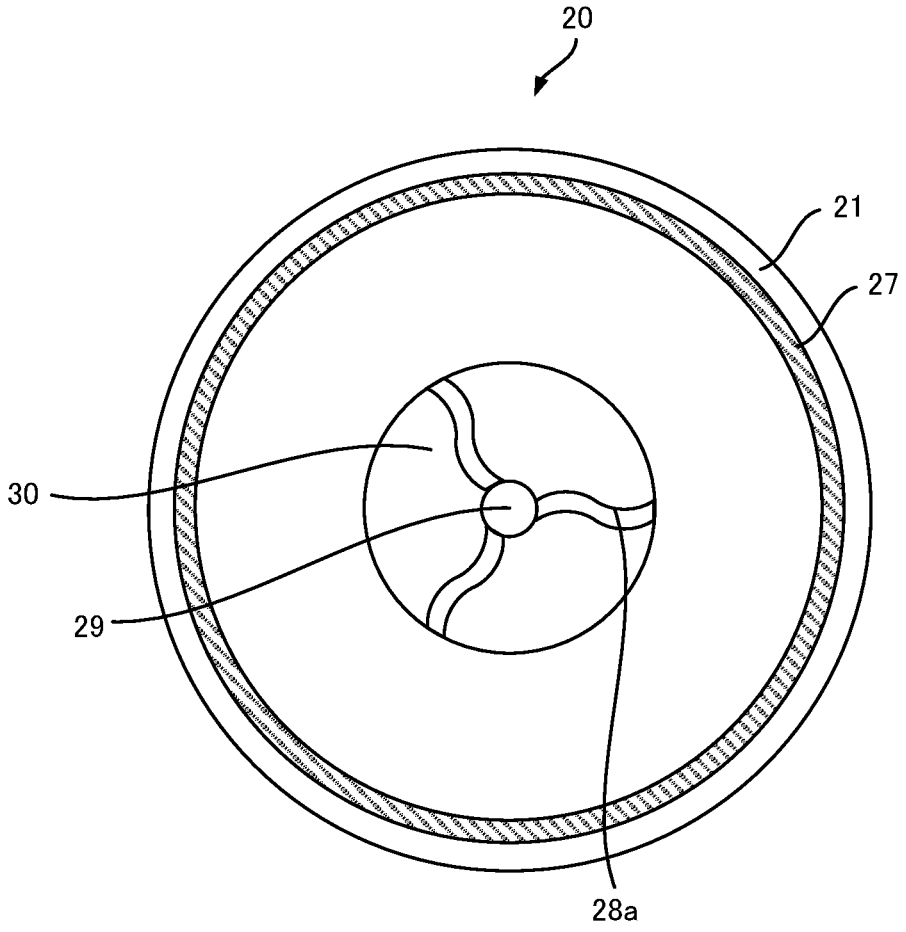
FIG. 12 shows a shape of a displacement part 28*a*.

FIG. 12 shows a shape of a displacement part 28*a* which is a Variation Example of the displacement part 28. The displacement part 28 shown in FIG. 4 is configured by a linear rod-like member, but the displacement part 28*a* includes a curved member, which is longer than the radius of the sound emitting part 30. Since the displacement part 28*a* includes such a curved member, the displacement part 28*a* can be displaced to a greater degree than the displacement part 28 in a direction in which a sound is emitted from the sound emitting part 30.

Variation Example of the Electro-Acoustic Conversion Device

In the above explanation, the canal type earphone 1 was illustrated as an example of the electro-acoustic conversion device, and cases where the electro-acoustic transducers 20, 20*a*, 20*b*, and 20*c* are respectively provided in the canal type earphone have been given as examples, but the electro-acoustic conversion device is not limited to the canal type earphone 1. The electro-acoustic transducers 20, 20*a*, 20*b*, and 20*c* can be applied to any electro-acoustic conversion device as long as the device is capable of converting an electrical signal into a sound. For example, the electro-acoustic transducers 20, 20*a*, 20*b*, and 20*c* may be provided in overhead headphones.

Effects of the Electro-Acoustic Transducer According to the Present Embodiment As described above, the electro-acoustic transducers 20, 20*a*, 20*b*, and 20*c* each have the contacting part 29 that contacts the partial region of the diaphragm 25 with the surface having elasticity. Since the electro-acoustic transducers 20, 20*a*, 20*b*, and 20*c* each have the contacting part 29 configured in such a manner, the stress applied to the diaphragm 25 when the diaphragm 25 is pressed against the fixed electrode 22 can be reduced. As a result, the diaphragm 25 of the electro-acoustic transducer 20, 20*a*, 20*b*, 20*c* is hardly damaged. Also, since the contacting part 29 is formed of the materials having elasticity, the electro-acoustic transducers 20, 20*a*, 20*b*, and 20*c* hardly generate noise even if the diaphragm 25 is separated from the fixed electrode 22 or is in contact with the fixed electrode 22.

The present invention is explained on the basis of the exemplary embodiments. The technical scope of the present invention is not limited to the scope explained in the above embodiments and it is possible to make various changes and modifications within the scope of the invention. For example, the specific embodiments of the distribution and integration of the apparatus are not limited to the above embodiments, all or part thereof, can be configured with any unit which is functionally or physically dispersed or integrated. Further, new exemplary embodiments generated by arbitrary combinations of them are included in the exemplary embodiments of the present invention. Further, effects of the new exemplary embodiments brought by the combinations also have the effects of the original exemplary embodiments.

What is claimed is:

1. An electro-acoustic transducer for converting an electrical signal into a sound, the electro-acoustic transducer comprising:

a housing having a sound emitting part that emits the sound to the outside;

a fixed electrode fixed to the housing;

a diaphragm that oscillates in accordance with a potential difference between the diaphragm and the fixed electrode generated based on the electrical signal, wherein the diaphragm faces the fixed electrode; and a support part that supports a partial region of the diaphragm toward the fixed electrode, the support part including, a displacement part that is displaced in a direction in which the diaphragm is displaced in response to a change in pressure inside the housing, and a contacting part that is coupled to the displacement part and contacts the partial region with a surface having elasticity, wherein a distance between the diaphragm and the fixed electrode in the partial region is less than a distance between the diaphragm and the fixed electrode outside the partial region, the partial region of the diaphragm is configured to contact the fixed electrode by a pressure applied by the contacting part.

2. The electro-acoustic transducer according to claim 1, wherein the displacement part is provided at a position between the diaphragm and the sound emitting part in a manner traversing an opening of the sound emitting part when the displacement part is seen from the opening.

3. The electro-acoustic transducer according to claim 1, wherein the displacement part has one or more rod-shaped members that traverse the sound emitting part.

4. The electro-acoustic transducer according to claim 1, wherein the displacement part has a plurality of rod-shaped members each having one end fixed to an opening of the sound emitting part, and the contacting part is provided at a position where the plurality of rod-shaped members are coupled.

5. The electro-acoustic transducer according to claim 4, wherein the plurality of rod-shaped members has a shape that becomes thinner toward the center of the opening.

6. The electro-acoustic transducer according to claim 1, wherein the contacting part is formed of a resin having elasticity.

7. The electro-acoustic transducer according to claim 6, wherein the resin includes a material that increases elasticity as time passes.

8. The electro-acoustic transducer according to claim 1, wherein the electro-acoustic transducer is included in an earphone to be inserted into a human ear, and the displacement part is displaced in response to a pressure change in the housing that occurs when the earphone is worn in the human ear or when the earphone is removed from the human ear.

9. The electro-acoustic transducer according to claim 1, wherein the displacement part is displaced by receiving stress caused by a displacement of the diaphragm.

10. The electro-acoustic transducer according to claim 9, wherein an amount of displacement of a tip of the contacting part, when a predetermined stress in a direction in which the diaphragm is displaced is applied to the contacting part, is larger than an amount of displacement of the displacement part when the predetermined stress in the direction of displacement of the diaphragm is applied to the displacement part.

11. The electro-acoustic transducer according to claim 1, further comprising:

a first conductive member coupled to the fixed electrode on the side of the fixed electrode opposite the sound emitting part; and a second conductive member coupled to the diaphragm on the side of the sound emitting part with respect to the fixed electrode, wherein the diaphragm oscillates in accordance with the potential difference generated between the first conductive member and the second conductive member.

12. The electro-acoustic transducer according to claim 11, wherein the second conductive member includes:

an annular portion that contacts a peripheral portion of the diaphragm, and an extension portion that extends from at least a part of the annular portion to the opposite side of the sound emitting part with respect to the fixed electrode.

13. The electro-acoustic transducer according to claim 1, further comprising:

an electret layer provided on a surface of the fixed electrode facing the diaphragm.

14. The electro-acoustic transducer according to claim 1, wherein the contacting part has elasticity such that its surface deforms due to the displacement of the diaphragm toward the sound emitting part.

15. The electro-acoustic transducer according to claim 1, wherein the fixed electrode has a plurality of holes.

16. An electro-acoustic conversion device comprising:

a first electro-acoustic transducer; and a second electro-acoustic transducer, wherein the first electro-acoustic transducer is an electro-acoustic transducer for converting an electrical signal into a sound, the first electro-acoustic transducer includes:

a housing having a sound emitting part that emits the sound to the outside;

a fixed electrode fixed to the housing;

a diaphragm that oscillates in accordance with a potential difference between the diaphragm and the fixed electrode generated based on the electrical signal, wherein the diaphragm faces the fixed electrode; and a support part that supports a partial region of the diaphragm toward the fixed electrode, the support part including a displacement part that displaces in a direction in which the diaphragm is displaced in response to a change in pressure inside the housing, and a contacting part that is coupled to the displacement part and contacts the partial region with a surface having elasticity, the second electro-acoustic transducer is more sensitive to high frequencies than is the first electro-acoustic transducer, and the first electro-acoustic transducer is more sensitive to the low frequencies than is the second electro-acoustic transducer, and a distance between the diaphragm and the fixed electrode in the partial region is less than a distance between the diaphragm and the fixed electrode outside the partial region, and the diaphragm is configured to contact the fixed electrode in the partial region by pressure applied by the contacting part.

* * * * *